US010977905B2

(12) United States Patent
Ghia et al.

(10) Patent No.: US 10,977,905 B2
(45) Date of Patent: Apr. 13, 2021

(54) LOTTERY TICKET BIN WITH PULL-OUT DRAWER AND TICKET GUIDE CONFIGURATION

(71) Applicant: Scientific Games International, Inc., Newark, DE (US)

(72) Inventors: Ajay J. Ghia, Cumming, GA (US); Sten Hallundbaek Mejenborg, Cumming, GA (US); James Jonathan Holbrook, Cumming, GA (US); Mark Andrew Thompson, Buford, GA (US)

(73) Assignee: Scientific Games International, Inc., Newark, DE (US)

( * ) Notice: Subject to any disclaimer, the term of this patent is extended or adjusted under 35 U.S.C. 154(b) by 31 days.

(21) Appl. No.: 16/572,711

(22) Filed: Sep. 17, 2019

(65) Prior Publication Data

US 2020/0098229 A1 Mar. 26, 2020

Related U.S. Application Data

(60) Provisional application No. 62/733,888, filed on Sep. 20, 2018.

(51) Int. Cl.
*G07F 17/42* (2006.01)

(52) U.S. Cl.
CPC ..... *G07F 17/42* (2013.01)

(58) Field of Classification Search
CPC ..... G07F 17/42; G07F 11/68; Y10T 225/35; Y10T 225/30; Y10T 225/10; Y10T 225/371; G07B 3/04; G07B 5/08; B65H 5/16; B65H 5/36
See application file for complete search history.

(56) References Cited

U.S. PATENT DOCUMENTS 6,575,090 B1 6/2003 Vienneau et al.
7,383,099 B2 * 6/2008 Pollard ..... G07F 17/32 700/232
2005/0178810 A1 * 8/2005 Woods ..... G07F 11/68 225/1

(Continued)

FOREIGN PATENT DOCUMENTS

EP 2 202 752 A2 6/2010

OTHER PUBLICATIONS

EPO Search Report, dated Jan. 17, 2020.

*Primary Examiner* — Gene O Crawford
*Assistant Examiner* — Ayodeji T Ojofeitimi
(74) *Attorney, Agent, or Firm* — Dority & Manning, P.A.

(57) ABSTRACT

A lottery ticket dispenser array includes a plurality of interconnected bins, wherein the bins include a housing having a bottom and an open top. A drawer is slidable into and out of the housing and includes an open top and a ticket compartment configured for receipt of a stack of the interconnected lottery tickets. A component section adjacent in the drawer is configured to automatically dispense the lottery tickets through a dispense slot upon receipt of a dispense command. Spaced-apart ticket guides are configured on an outer side of the bin bottom so as to extend through the open top and into the ticket compartment of the adjacent lower bin in the array. The ticket guides are configured to engage along at least side edges of the interconnected lottery tickets as they are dispensed or retracted relative to the ticket compartment.

16 Claims, 4 Drawing Sheets

(56) References Cited

U.S. PATENT DOCUMENTS

| | | | |
|---|---|---|---|
| 2006/0003605 | A1 | 1/2006 | Brooks et al. |
| 2014/0043162 | A1 | 2/2014 | Siciliano et al. |
| 2014/0046481 | A1 | 2/2014 | Siciliano et al. |
| 2017/0018148 | A1 | 1/2017 | Behm et al. |

* cited by examiner

LOTTERY TICKET BIN WITH PULL-OUT DRAWER AND TICKET GUIDE CONFIGURATION

PRIORITY

The present application claims the benefit of Provisional Application No. 62/733,888 filed Sep. 20, 2018.

BACKGROUND

Instant lottery tickets (e.g., "scratch-off" lottery tickets) are sold at many types of retail locations including, stores, such as grocery stores, general merchandise stores, and the like. Various configurations of lottery ticket dispensers have been proposed in the industry for this purpose, including electronic dispensers that automatically dispense a ticket from a bin or compartment upon receipt of an electronic command signal.

For example, U.S. Pat. Publication No. 2017/0018148 describes a lottery ticket dispenser array that is configured in communication with a lottery ticket terminal and includes a plurality of separate dispensing bins having a different respective lottery ticket stored therein. For example, the dispenser array may include ten separate bins, with each bin containing a supply of different scratch-off lottery ticket games. Each lottery ticket contained in the bins includes a machine readable code printed thereon, such as a bar code, QR code, or the like. Each bin in the array includes an electronic drive mechanism that, when activated, dispenses one or more lottery tickets from the bin (depending on the number of tickets requested by the patron). Each bin also includes a scanner disposed to read the code on lottery tickets dispensed from the bin position. In operation of the system, the lottery ticket terminal transmits a purchase signal for dispensing a particular lottery ticket that is routed to the respective bin containing the lottery ticket, which activates the drive mechanism to dispense the requisite number of tickets. As the tickets are dispensed from the bin, the scanner may read the code printed on each ticket, which eventually results in a signal being routed to a central lottery server for each lottery ticket dispensed from the dispenser array. The code printed on each ticket contains identifying information unique to the ticket, and the signal transmitted to the central server enables actions relevant to the sale of the tickets, such as activating the ticket in the lottery provider's system, accounting for tickets sold at a particular retail establishment, reconciling tickets sold at a retail establishment with tickets delivered to the establishment, and for forth.

In the '148 publication, the stack of individual interconnected lottery tickets are maintained in an upright orientation within the bins. However, this array configuration has a disadvantage for an "under-counter" environment wherein the array would be placed beneath a counter at the point of sale (POS) location. The array has a tall height profile due to the height of the individual bins and access into the bins to load the lottery tickets is only by opening the front cover of the bins, which would be extremely inconvenient for the lower bins if the array were placed on or close to the floor and under a counter.

Configuring the individual bins with a shortened height profile that corresponds to the thickness of the flat ticket pack is beneficial in that the overall height of the array can be significantly reduced or under-counter applications. However, this requires a "laid down" flat orientation of the ticket stack, which presents problems with maintaining proper alignment of the tickets as they are pulled from the top of the fan-folded ticket pack. At least every other ticket must fold at least partially over itself in the dispense cycle, and this folding can result in ticket jams if not done in a controlled manner. The issue becomes more pronounced when tickets that have been dispensed out of the slot (but not separated) must be retracted back into the bin. It is important that such tickets fold back onto the stack in the same manner in which they were drawn from the stack. This process can be particularly problematic.

Thus, a ticket bin having a low profile wherein the lottery tickets are laid flat and positively guided during the dispense and retract sequences to minimize ticket jams would be beneficial in the art.

SUMMARY

Objects and advantages of the invention will be set forth in part in the following description, or may be obvious from the description, or may be learned through practice of the invention.

In accordance with aspects of the invention, a lottery ticket dispenser array having a plurality of individual ticket bins is provided. The array is particularly well-suited as an "under-counter" array due to its low profile and ease of loading new ticket stacks into the individual bins. One or more of the bins (preferably all of the bins) in the array include a housing having a bottom and an open top. A drawer is slidable into and out of the housing and includes an open top and at least one ticket compartment configured therein for receipt of a stack of the interconnected lottery tickets through the open top of the drawer. A component section is configured adjacent a front of the drawer to automatically dispenses one or more of the lottery tickets through a dispense slot upon receipt of a dispense command. The component section is configured with control components such as, for example, a motorized drive mechanism, a scanner or other optical reader, a tear bar or perforation separation edge, a control board, and so forth.

Spaced-apart ticket guides are configured on an outward side of the bottom of the bins with a shape and size so as to extend through the open top and into the ticket compartment of the immediately adjacent lower bin in the array. The ticket guides are configured to engage along at least side edges of the interconnected lottery tickets as the interconnected lottery tickets are pulled from the ticket compartment in a dispense sequence or pushed back into the ticket compartment in the event that dispensed tickets need to be driven back into the ticket compartment, for example when a purchaser decides not to purchase the dispensed tickets, the dispense action misreads dispensed tickets, or the store clerk activates the wrong dispenser module.

The ticket guides can be variously configured within the scope and spirit of the invention. In one embodiment, the ticket guides may be continuous rail members that extend longitudinally along the outward side of the bottom. The rail members may be separately formed and attached to the bottom, or integrally molded with the bottom. In an alternate embodiment, the ticket guides may be discontinuous rail members arranged longitudinally along the outward side of the bottom. For example, each rail member may include a series of longitudinally spaced-apart rail sections that are separately attached or formed integral with the bottom.

The ticket guides may have various cross-sectional profiles. In one embodiment, the ticket guides may be essentially straight, vertical walls, wherein the interconnected lottery tickets move up between the walls upon being dispensed (or pushed back), but are free to fall back onto stack.

In an alternate embodiment, the ticket guides may include transversely extending legs that are offset from the outward side of the bottom so as to retain the interconnected lottery tickets above the stack. In this manner, the ticket guides act as a channel along the opposite sides of the lottery ticket. The ticket guides may, in this embodiment, be formed as rigid channel members.

In an alternate embodiment, the transversely extending legs may be flexible so as to bend and allow the interconnected lottery tickets to move upward and between the ticket guides prior to the legs returning to a retaining position where the interconnected lottery tickets are held above the stack. For example, the transversely extending legs may be rigid, but attached with a hinge mechanism, such as a living hinge, to a vertical leg. In another embodiment, the transversely extending legs may be formed of a resilient, bendable material that "gives" as the lottery tickets are pushed upwards between the ticket guides and then "springs back" into a retaining position. In this embodiment, the ticket guides may be formed as curved members, such as a continuous arc member.

In one embodiment, the bin drawers may be configured to store and dispense at least two separate stacks of the interconnected lottery tickets and include adjacent component sections and adjacent ticket compartments. Corresponding pairs of the ticket guides are configured on the outward side of the bottom of the bins such that one of the pairs of ticket guides is provided for each ticket compartment of the adjacent lower bin in the array.

The present invention also encompasses individual ones of the bins as described above.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Figure 1:
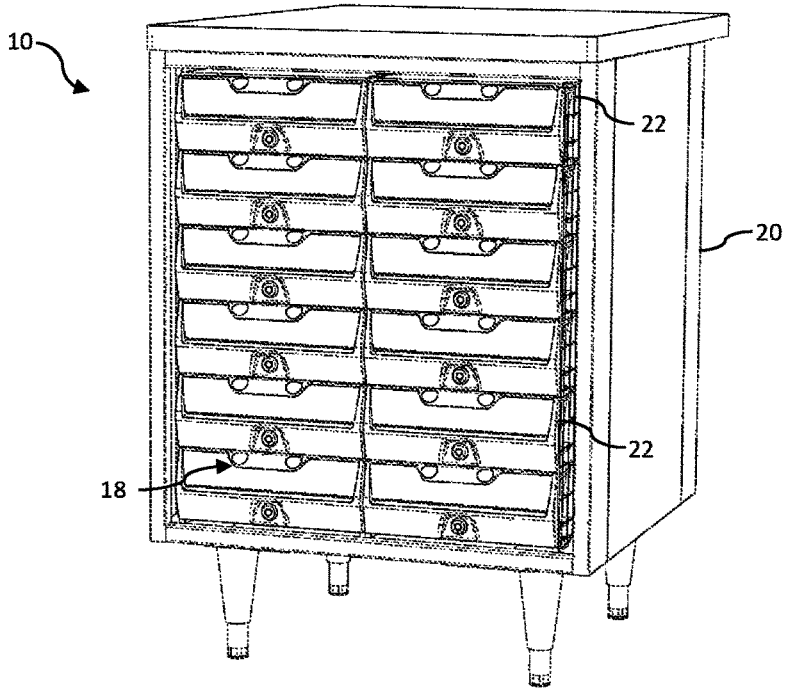
FIG. 1 is a perspective view of an embodiment of a lottery ticket dispenser array within a cabinet in accordance with aspects of the present invention.

FIG. 1 depicts an embodiment of a dispenser array 10 for dispensing interconnected lottery tickets 62 (FIG. 7) at a retail establishment, such as a convenience store, retail store, pub, restaurant, or the like, that is generally authorized by a lottery jurisdiction to carry out lottery activities, such as the sale of instant scratch-off tickets or terminal printed draw tickets for games such as Powerball™. The lottery jurisdiction may be a state lottery authority, such as the Pennsylvania Lottery, or any other governmental jurisdictional authority. A separate game provider may be partnered with the lottery jurisdiction to provide certain control, implementation, and logistical functions of the game. It should be appreciated that the type of retail establishment or lottery jurisdiction entities are not limiting factors of the invention.

Figure 2:
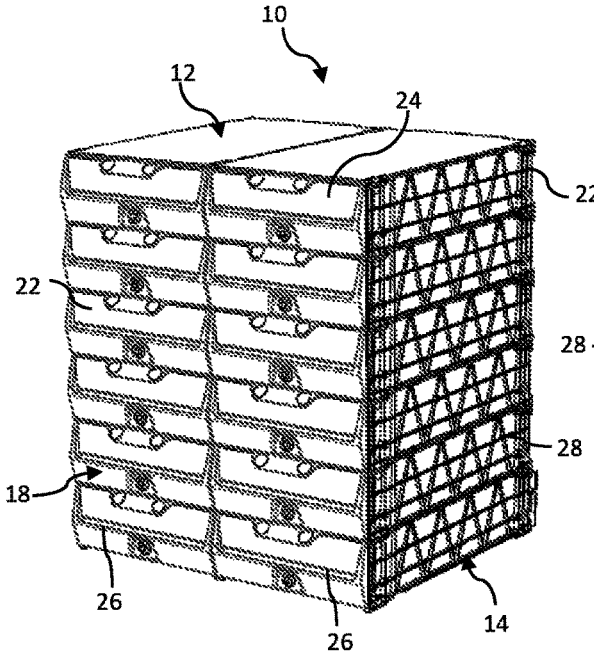
FIG. 2 is a front perspective view of the lottery ticket dispenser array removed from the cabinet.
Figure 3:
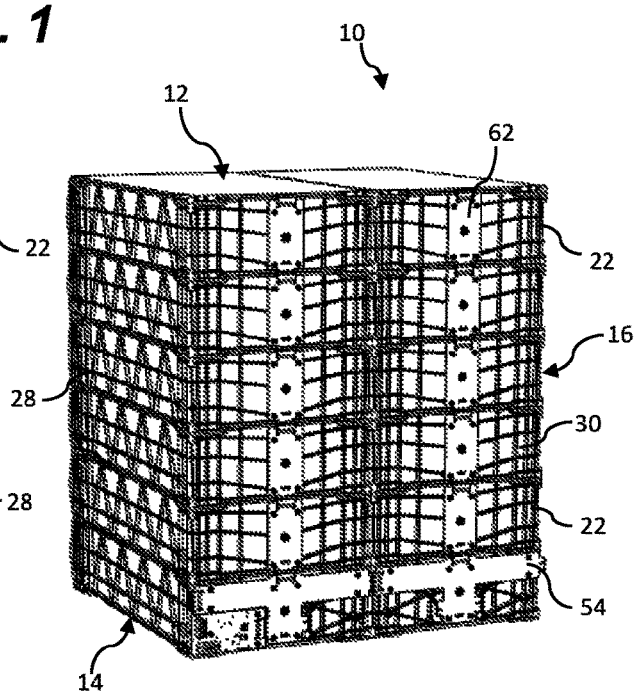
FIG. 3 is a back perspective view of an embodiment of a lottery ticket dispenser array.

Referring to FIGS. 1-3 in general, the array 10 includes a plurality of separate ticket bins 22 (described in greater detail below) that, collectively, define a top 12, sides 14, back 16, and front 18 of the array 10. The bins 22 may be physically interconnected within the array by any manner of suitable structure provided on the sides, top, or bottom of the bins 22. Each bin 22 has a front face 24 with a dispensing slot 26 through which lottery tickets 62 contained in the bin 22 are dispensed.

In the depicted embodiment, the bins 22 (and hence the array 10) have a relatively low height profile and are designed to contain a flat stack 60 (FIG. 7) of fan-folded and interconnected lottery tickets 62 laid flat in the respective bins 22. The individual lottery tickets 62 are separated by perforation lines 64 within the stack 60. This configuration is particularly well-suited for an "under-counter" system wherein the array 10 is operationally located within a cabinet 20 (FIG. 1) that is sized to fit under a retail counter. This arrangement removes the array from on or above the retail counter and frees up valuable space at the point of sale (POS) counter at the retail establishment, which is highly desirable to retailers.

Figure 4:
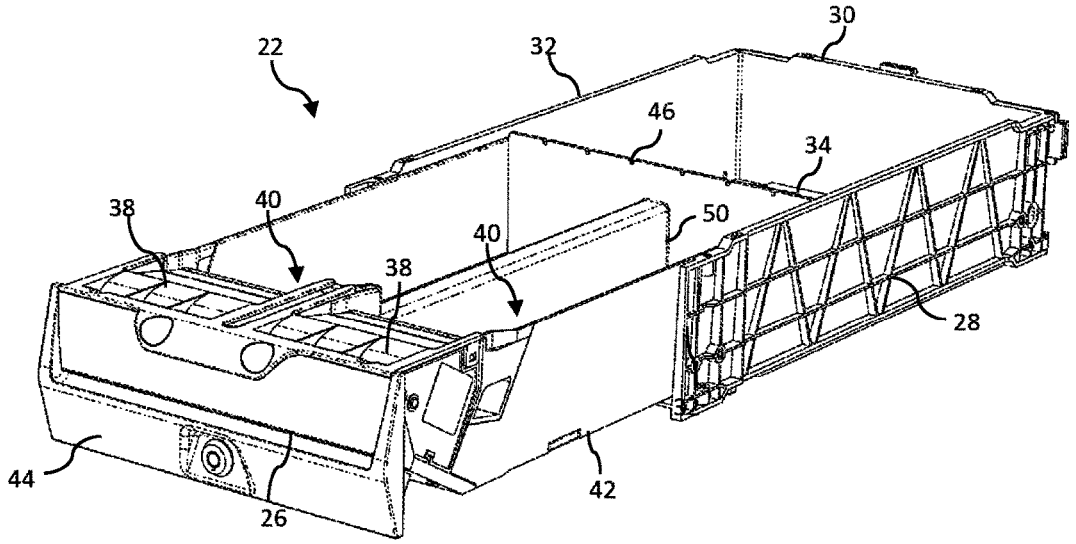
FIG. 4 is a front perspective view of an individual ticket bin from the lottery ticket dispenser array of FIG. 2.
Figure 5:
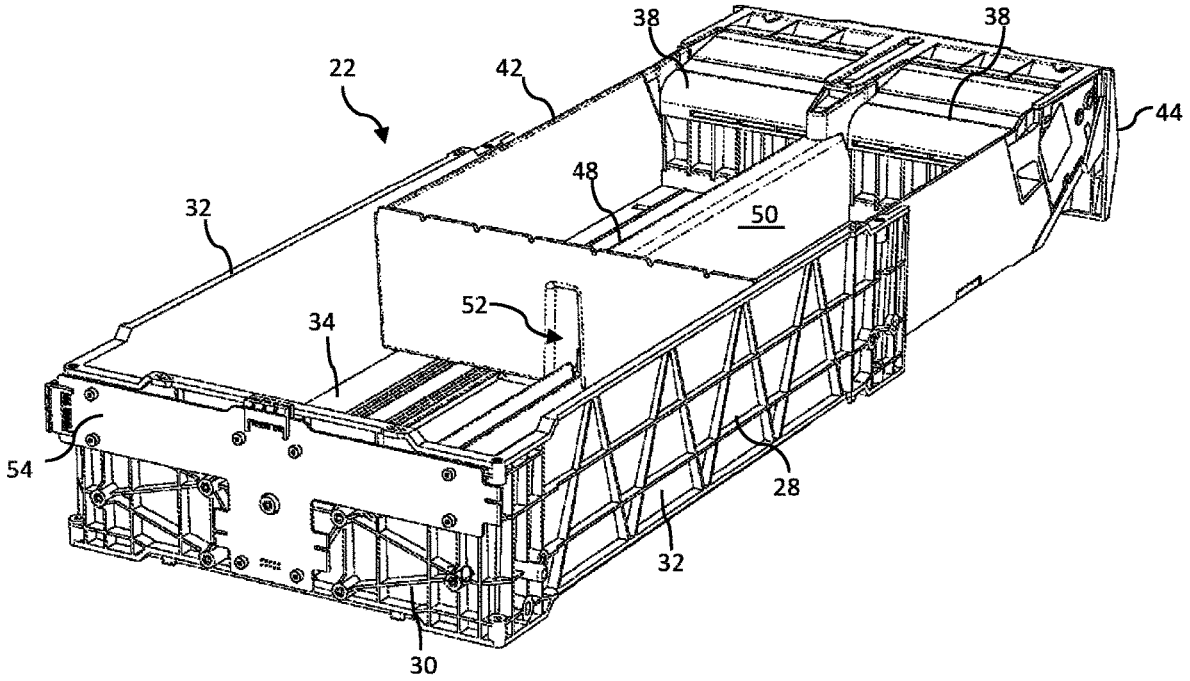
FIG. 5 is a front perspective view of the bin of FIG. 4 with the drawer in an open position.

Referring to FIGS. 4 and 5, each bin 22 defines at least one internal ticket compartment 40 for receipt of a supply of lottery tickets, for example in the form of a fan-folded stack of interconnected tickets or a roll of interconnected tickets. In the depicted embodiment, each bin 22 is configured to house and dispense two separate supplies of lottery tickets and includes side-by-side ticket compartments 40 separated by an internal wall 50. Each ticket compartment 40 includes an operational component section 38 at the front thereof that may include a drive mechanism, scanner or other type of reader, cutting bar, edge, or other separation mechanism, control circuitry, and so forth. It should be appreciated that each bin 22 may include any number of ticket compartments 40 and associated component sections 38.

Each bin 22 has an open-top housing structure 28 that includes sides 32 and a back side 30. The back sides 30 collectively define the back 16 of the dispenser array 10. A circuit board 54 is fixed to an exterior of the back side 30 of each bin housing 28 and is configured to supply power and control functions to the bin, in particular to the component section 38. For example, as mentioned, each bin 22 (or component section 38 within the bin 22) may include a drive mechanism that dispenses an individual lottery ticket 62 from the bin 22 through the dispense slot 26 upon receipt of a dispense signal via the circuit board 54, wherein power to the drive mechanism is also provided via the circuit board 54. Each bin 22 (or component section 38) may also include a scanner that reads a code on the lottery ticket as the ticket is dispensed, wherein power to the scanner is provided via the circuit board 62 and the scanned code is transmitted from the scanner via the circuit board 54 to a downstream controller or central lottery server/computer that is in communication with the dispenser array 10. It should be appreciated that the array 10 is not limited by the power or control functions that are provided by the circuit boards 62 or performed by the operational components within the component section 38.

A power/data cable connects between the circuit board 62 and the component section(s) 38 and folds into a chamber 52 defined within the internal wall 50 as the drawer 36 is pulled out and pushed back into the bin housing 28.

Each bin 22 includes an open-top drawer 36 that is slidable into and out of the housing 28. The drawer includes sides 42, front wall 44, floor or bottom 48, and a back wall 46. The bottom 48 of the drawer has an outward face or surface 35.

In the illustrated embodiment, the drawer 36 includes the one or more ticket compartments 40, wherein the tickets can be loaded into the compartments 40 through the open top of the drawer 36. Also the component sections 38 are configured within and adjacent a front wall 44 of the drawer 36, and the dispense slot 26 is defined in the front wall 44 of the drawer 36.

Referring to FIGS. 6 through 10 in general, spaced-apart ticket guides 68 are configured on the outward side 35 of the bin bottom 48 and have a shape, length, and size so as to extend through the open top and into the ticket compartment 40 of the immediately adjacent lower bin 22 in the array 10. The ticket guides 68 are configured to engage along at least side edges 66 of the interconnected lottery tickets 62 as the lottery tickets are pulled from the ticket compartment 40 in a dispense sequence or pushed back into the ticket compartment 40 in the event that dispensed tickets 62 need to be driven back into the ticket compartment 40, for example when a purchaser decides not to purchase the dispensed tickets 62 or the dispense command was issued to a wrong ticket bin 22, and so forth. The ticket guides 68 serve to keep the tickets 62 aligned with the functional components in the component section 38 during the dispense or retract sequence, particularly as more and more tickets 62 are dispensed and the size of the stack 60 diminishes. The ticket guides 68 tend to keep the tickets 62 from curling or folding onto themselves as they are dispensed or retracted. Particularly during the retract sequence, the ticket guides 68 ensure that the individual tickets 62 fold back onto the stack 60 in the same fan-fold arrangement in which they were dispensed.

Figure 6:
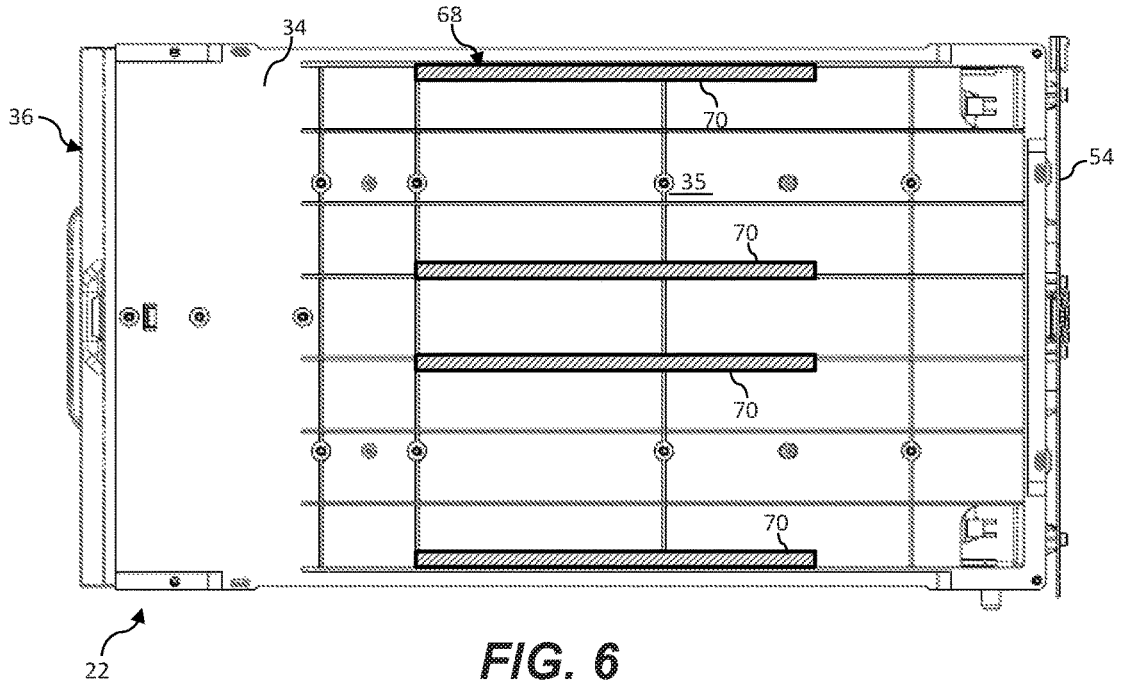
FIG. 6 is an underside view of the bottom of the bin housing particularly depicting pairs of ticket guide members.
Figure 7:
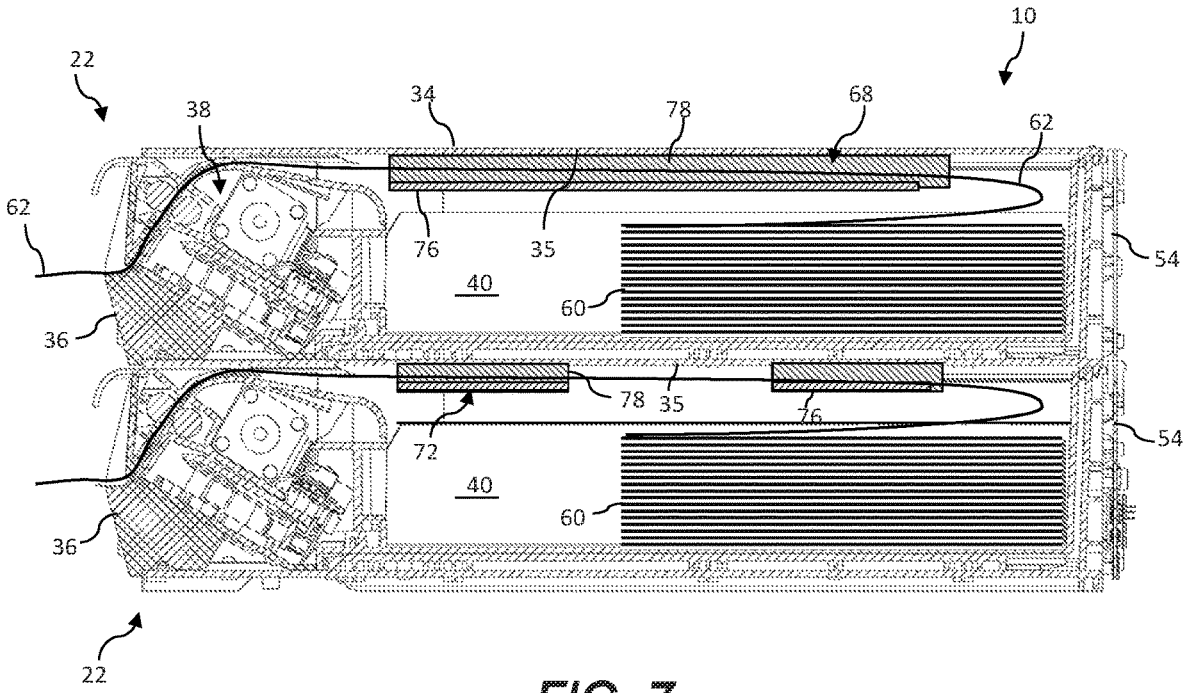
FIG. 7 is a cut-away side view of stacked ticket bins.

As seen in FIGS. 6 and 7, the ticket guides 68 do not necessarily extend along the entire longitudinal length of the ticket compartment 40, but may have a rear end that is forward (toward the front wall 44 of the drawer 36) of the rear of the ticket stack 60. This space allows the individual tickets 62 to properly unfold from the stack 60 as they are dispensed, or to re-fold back onto the stack as they are retracted.

The ticket guides 68 can be variously configured. In the embodiment depicted in FIG. 6 and the upper bin 22 of FIG. 7, the ticket guides 68 are generally continuous rail members that extend longitudinally along the outward side of the bottom with a suitable cross-sectional profile. The rail members 70 may be separately formed and attached (e.g., adhered or otherwise fastened) to the outer surface 35 of the housing bottom 48. Alternatively, the ticket guides 68 (in whatever form) may be integrally molded with the bottom 48.

In the embodiment depicted in the lower bin 22 in FIG. 7, the ticket guides 68 are implemented as discontinuous rail members defined by a series of spaced-apart rail sections 72 arranged longitudinally along the outer surface 35 of the bottom 48. The rail sections 72 may have the same or different cross-sectional profiles depending on their location.

Figure 8:
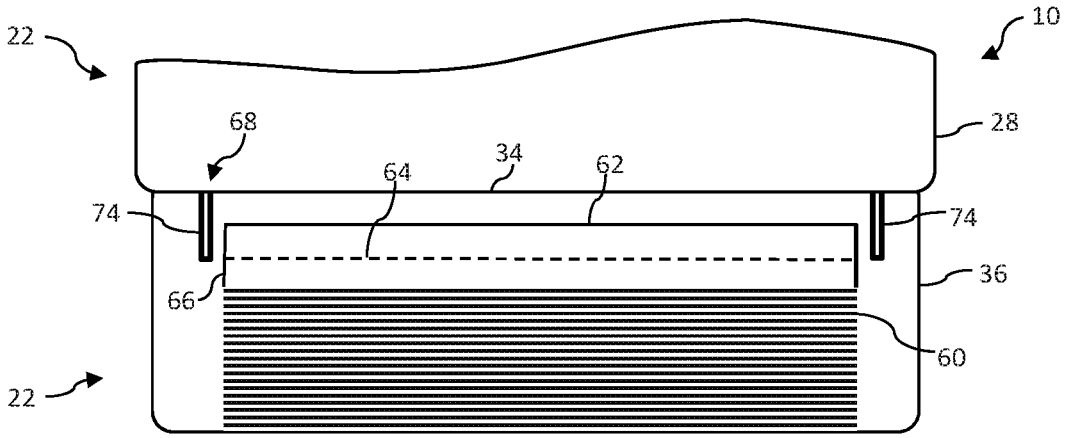
FIG. 8 is front cut-away view of stacked bins depicting an embodiment of the ticket guide members on the underside of the upper bin.

The ticket guides 68 may have various cross-sectional profiles. In the embodiment of FIG. 8, the ticket guides 68 are essentially straight, vertical walls 74. With this configuration, the interconnected lottery tickets 62 move up between the walls upon being dispensed or retracted, but are free to fall back onto stack 60 in a static mode of the bin 22.

Figure 9:
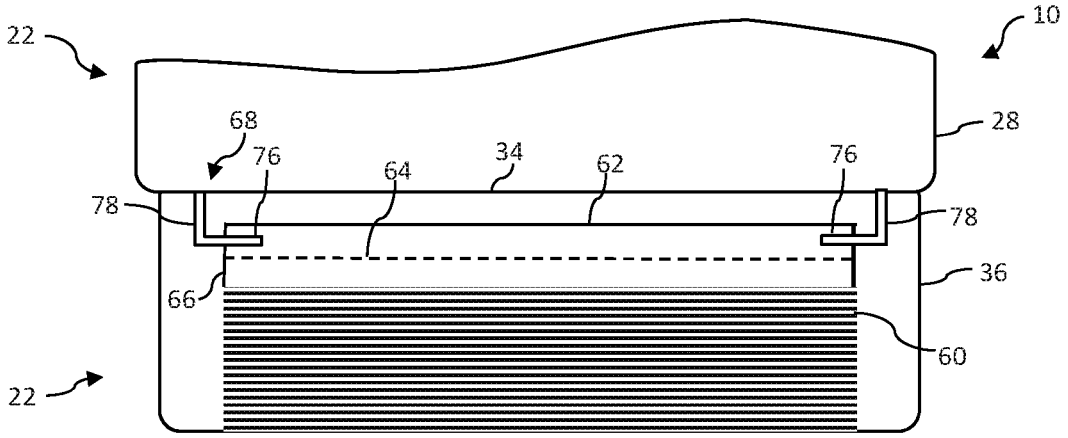
FIG. 9 is front cut-away view of stacked bins depicting an alternate embodiment of the ticket guide members on the underside of the upper bin.

In an alternate embodiment depicted in FIG. 9, the ticket guides 68 include transversely extending legs 76 that are offset from the outer surface 35 of the bottom 48 by vertical legs 78. The transverse legs 76 define a channel in which the edges 66 of the tickets 62 move as they are dispensed or retracted relative to the ticket compartment 40. The ticket guides 68 in this embodiment may be generally rigid "L"-shaped (or other angled) members. The transverse spacing between opposite guides 68 (or length of the transverse legs 76 should be selected so that the tickets 62 can bend (along a longitudinal aspect) and pass above the legs 76 in an initial dispense or ticket-threading process when new ticket stacks 60 are loaded into the bin 22. Once the tickets 62 pass above the transverse legs 76, they move along the channel defined by the ticket guides 68 and are retained above the stack 60.

Figure 10:
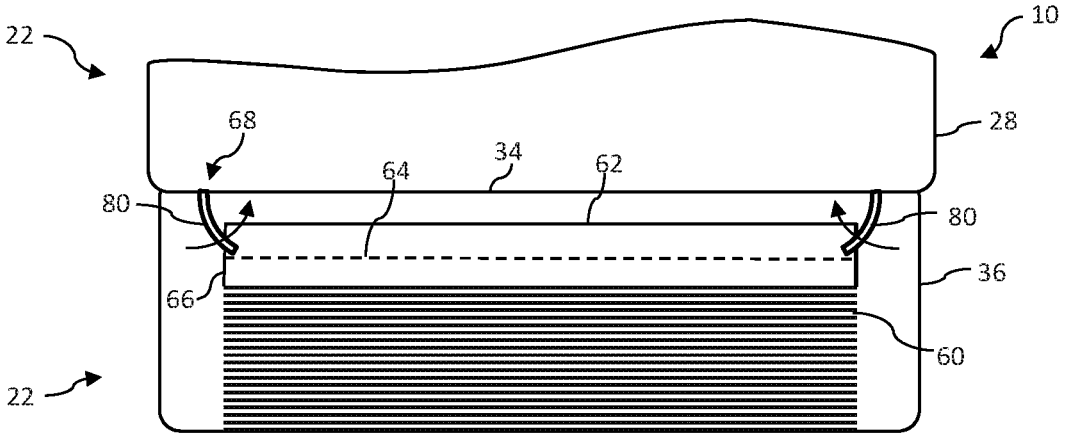
FIG. 10 is front cut-away view of stacked bins depicting another embodiment of the ticket guide members on the underside of the upper bin.

In an alternate embodiment, the transversely extending legs 76 may be flexible so as to flex or bend and allow the interconnected lottery tickets 60 to move upward and between the ticket guides 68 without bending of the tickets 62. For example, the transversely extending legs 76 may be rigid, but can be attached with a hinge mechanism, such as a living hinge, to the vertical leg 78. In another embodiment, the transversely extending legs 76 may be formed of a resilient, bendable material that "gives" as the lottery tickets are pushed upwards between the ticket guides and then "springs back" into a retaining position. For example, FIG. 10 depicts an embodiment wherein the ticket guides 68 are formed as resilient curved members, such as a continuous arc member, that flex as indicated by the arrows to allow the tickets 62 to move above the guides 68 and, thus, be retained by the guides 68 above the ticket stack 60.

In the embodiment depicted in FIGS. 4 through 6, the bin drawers 36 are configured to store and dispense at least two separate stacks 60 of the interconnected lottery tickets 62, wherein each drawer 36 includes adjacent component sections 38 and adjacent ticket compartments 40. Corresponding pairs of the ticket guides 68 are configured on the outer side 35 of the bin bottom 34 such that one of the pairs of ticket guides 68 is provided for each ticket compartment 40 of the adjacent lower bin 22 in the array 10.

As discussed, the present invention also encompasses an individual lottery ticket bin 22, as described above.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A lottery ticket dispenser array, comprising:

a plurality of interconnected bins, wherein one or more of the bins further comprises:

a housing having a bottom and an open top;

a drawer slidable into and out of the housing, the drawer comprising an open top and at least one ticket compartment configured for receipt of a stack of interconnected lottery tickets;

a component section adjacent a front of the drawer that automatically dispenses one or more of the lottery tickets through a dispense slot upon receipt of a dispense command;

spaced-apart ticket guides configured on an outward side of the bottom so as to extend through the open top and into the ticket compartment of an adjacent lower bin in the array; and the ticket guides configured to engage along at least side edges of the interconnected lottery tickets as the interconnected lottery tickets are pulled from the ticket compartment or pushed back into the ticket compartment.

2. The lottery ticket dispenser array as in claim 1, wherein for each bin, the drawer is configured to store and dispense at least two separate stacks of the interconnected lottery tickets and comprises adjacent component sections and adjacent ticket compartments, and further comprising corresponding pairs of the ticket guides configured on the outward side of the bottom such that one of the pairs of ticket guides is provided for each ticket compartment of the adjacent lower bin in the array.

3. The lottery ticket dispenser array as in claim 1, wherein the ticket guides comprise continuous rail members extending longitudinally along the outward side of the bottom.

4. The lottery ticket dispenser array as in claim 1, wherein the ticket guides comprise discontinuous rail members arranged longitudinally along the outward side of the bottom.

5. The lottery ticket dispenser array as in claim 1, wherein the ticket guides comprise vertical members such that the interconnected lottery tickets are free to fall back onto stack.

6. The lottery ticket dispenser array as in claim 1, wherein the ticket guides comprise transversely extending legs set off from the outward side of the bottom so as to retain the interconnected lottery tickets above the stack.

7. The lottery ticket dispenser array as in claim 6, wherein the transversely extending legs are rigid.

8. The lottery ticket dispenser array as in claim 6, wherein the transversely extending legs are flexible so as to bend and allow the interconnected lottery tickets to move upward and between the ticket guides prior to the legs returning to a retaining position where the interconnected lottery tickets are held above the stack.

9. A lottery ticket bin for use in multi-bin dispenser array, comprising:

a housing having a bottom and an open top;

a drawer slidable into and out of the housing, the drawer comprising an open top and at least one ticket compartment configured for receipt of a stack of interconnected lottery tickets;

a component section adjacent a front of the drawer that automatically dispenses one or more of the lottery tickets through a dispense slot upon receipt of a dispense command;

spaced-apart ticket guides configured on an outward side of the bottom so as to extend through the open top and into the ticket compartment of an adjacent lower bin in the array; and the ticket guides configured to engage along at least side edges of the interconnected lottery tickets as the interconnected lottery tickets are pulled from the ticket compartment or pushed back into the ticket compartment.

10. The lottery ticket bin as in claim 9, wherein the drawer is configured to store and dispense at least two separate stacks of the interconnected lottery tickets and comprises adjacent component sections and adjacent ticket compartments, and further comprising corresponding pairs of the ticket guides configured on the outward side of the bottom such that one of the pairs of ticket guides is provided for each ticket compartment of the adjacent lower bin in the array.

11. The lottery ticket bin as in claim 9, wherein the ticket guides comprise continuous rail members extending longitudinally along the outward side of the bottom.

12. The lottery ticket bin as in claim 9, wherein the ticket guides comprise discontinuous rail members arranged longitudinally along the outward side of the bottom.

13. The lottery ticket bin as in claim 9, wherein the ticket guides comprise vertical members such that the interconnected lottery tickets are free to fall back onto stack.

14. The lottery ticket bin as in claim 9, wherein the ticket guides comprise transversely extending legs set off from the outward side of the bottom so as to retain the interconnected lottery tickets above the stack.

15. The lottery ticket bin as in claim 14, wherein the transversely extending legs are rigid.

16. The lottery ticket bin as in claim 14, wherein the transversely extending legs are flexible so as to bend and allow the interconnected lottery tickets to move upward and between the ticket guides prior to the legs returning to a retaining position where the interconnected lottery tickets are held above the stack.

* * * * *